United States Patent [19]

Kuntz, Jr.

[11] 4,290,158

[45] Sep. 22, 1981

[54] MOORING BUOY

[75] Inventor: Francis A. Kuntz, Jr., San Pedro, Calif.

[73] Assignee: Amtel, Inc., Providence, R.I.

[21] Appl. No.: 116,098

[22] Filed: Jan. 28, 1980

Related U.S. Application Data

[63] Continuation of Ser. No. 784,132, Apr. 4, 1977, abandoned.

[51] Int. Cl.[3] ..... B63B 21/52

[52] U.S. Cl. ..... 9/8 P; 114/230

[58] Field of Search ..... 9/8 P; 114/230; 141/387, 388

[56] References Cited

U.S. PATENT DOCUMENTS 2,882,536 4/1959 Jordan ..... 9/8 P
3,481,294 12/1969 Vincent ..... 9/8 P X
4,010,500 3/1977 Reid, Jr. ..... 9/8 P
4,042,990 8/1977 Donaldson, Jr. ..... 114/230 X

FOREIGN PATENT DOCUMENTS 1384983 2/1975 United Kingdom ..... 9/8 P

*Primary Examiner*—Sherman D. Basinger
*Attorney, Agent, or Firm*—Freilich, Hornbaker, Wasserman, Rosen & Fernandez

[57] ABSTRACT

A buoy, for mooring vessels, has a rotatable turntable on the top, which rotates about the vertical axis of the buoy. A rigid mooring yoke is pivotably coupled to vessels at one end, and has the other end pivotably coupled to the buoy through structure that positions the coupling point at a location such that any tendency for the buoy to turn over in response to angular movement of the yoke and forces applied by the yoke from the vessel is prevented.

3 Claims, 6 Drawing Figures

MOORING BUOY

This is a continuation, of application Ser. No. 784,132, filed Apr. 4, 1977, now abandoned.

BACKGROUND OF THE INVENTION

This invention relates to improvements in buoys for mooring vessels.

In U.S. Pat. Nos. 3,823,432, and 3,908,212, there is described and shown buoys with associated mooring yokes, which are attached to the buoys in such a manner that they form a rigid integral unit therewith. In one instance the mooring yoke is rigidly attached to a bearing which surrounds the periphery of the buoy, and in the other instance the mooring yoke is attached rigidly to a turntable which rotates on the top of the buoy. The reason for this type of coupling is indicated as being required because buoys with associated mooring arrangements, of the type previously used, principally constituting a yoke pivotably hinged with respect to the turntable on top of the buoy, are subjected to tide and weather conditions which require the buoy to have a considerable inherent stability to cope with the forces exercised thereon by the mooring arrangement, without which the buoy would be tipped over. To overcome this tipping proclivity, the buoy needs to have a relatively large mass, with the result that the forces which the rigid coupling members apply to the mooring arrangement are of considerable magnitude. Also a more expensive buoy must be built than one having a lesser mass.

The advantage postulated for the arrangements described, is that, by essentially making the buoy and the yoke unitary, except for the pivoting capability, the requirement for the buoy to have a relatively large mass to provide inherent stability is considerably reduced and the buoy's tendency to tip in response to these forces is also reduced.

In U.S. Pat. No. 4,148,107 by Karl et al entitled Mooring Buoy, which is assigned to a common assignee, there is described an arrangement for coupling the mooring yoke to a buoy, which avoids the problems produced by structure built in accordance with the teachings of the indicated patents. The same benefits as are claimed for the patented structures, are obtained by providing "bumper" equipment on either side of the location of the pivotable axis of the mooring yoke to the turntable, so that, if the pivotable motion of the mooring yoke exceeds a predetermined arc, for all intents and purposes, the mooring yoke and the buoy act as if they were rigidly coupled.

OBJECTS AND SUMMARY OF THE INVENTION

An object of this invention is to provide another arrangement for coupling a yoke arm to a mooring buoy which minimizes the tendency of a buoy to tip and thus enables a buoy having less mass than previously required to be used.

Another object of the invention is to provide a novel, simple and relatively inexpensive method and means for coupling a yoke to a buoy which minimizes the tendency of the buoy to tip in response to forces applied by the yoke and angular movements of the yoke.

The foregoing and other objects of the invention are achieved by providing means for coupling the yoke to the buoy so that the forces applied by the yoke to the buoy are applied substantially at the location or the intersection of the vectors representing buoy weight and yoke weight with the force vector representative of the resultant forces attributable to the chains which anchor the buoy to the sea floor. This point of intersection locates the buoy's pitch axis. One of these arrangements comprises using a U-shaped member which is supported by the rotatable deck on the buoy, which has arms which extend downward over the sides of the buoy far enough so that the ends of the yoke may be pivotably coupled thereto at the intersection of the indicated vectors. In another embodiment, the U-shaped member pivotably supports a ring in a plane including the point of intersection of said vectors. The yoke is pivotably connected to said ring.

Another embodiment of the invention uses a gimbal ring connected to the buoy at a location such that the yoke arms may be pivotably connected thereto at the indicated intersection of the vectors. The gimbal ring is allowed to rotate around the vertical axis of the buoy as well. The gimbal rings are rotatably supported by the buoy in place which includes the point of intersection of the vectors.

DESCRIPTION OF THE PREFERRED EMBODIMENTS

Figure 1:
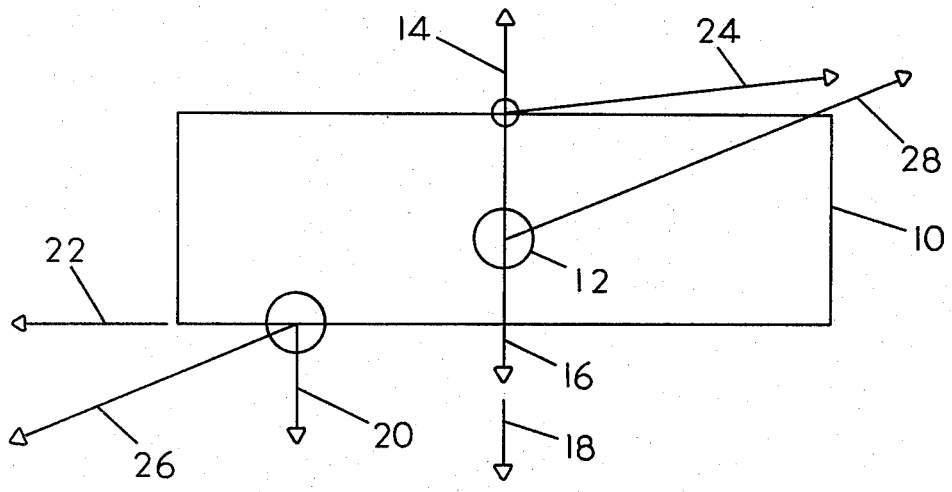
FIGS. 1 and 2 are vector diagrams respectively illustrating the forces applied to a buoy when the yoke coupling the buoy to the ship has tension applied thereto and when it has compression applied thereto.

Referring now to FIG. 1, there may be seen a vector diagram, illustrative of the forces applied to a buoy 10. The pitch axis 12 of the buoy represents the location about which the buoy pitches as a result of all of the forces applied thereto. The buoyancy of the buoy provides an upward force, represented by the arrow 14, which passes through the pitch axis 12. The weight of the buoy is represented by the arrow 16 and the weight of the yoke is represented by the arrow 18. These two are in a direction opposite to the vector 14 of the buoyancy and also pass through the pitch axis.

Chains, which anchor the buoy, have two vectors. One of these is a vertical vector downward represented by the arrow 20, which is the weight of the chain on the buoy. The other arrow 22, represents the horizontal vector of the chain, which is in a direction to resist the forces applied to the buoy in tension, by the conventionally coupled yoke vector 24. The resultant of the two chain vectors is shown as a resultant arrow 26, and it too, when extended, passes through the pitch axis. The forces represented by the conventionally coupled yoke vector 24, which are applied to the buoy by a vessel, when the yoke is in tension, have a tendency to capsize the buoy which turns, in that situation, about its pitch axis 12. However, when, in accordance with this invention, the forces applied to the buoy, as represented by the vector 28, are applied at substantially near the pitch axis of the buoy, the tendency of the buoy to capsize by turning about the pitch axis is avoided.

Figure 2:
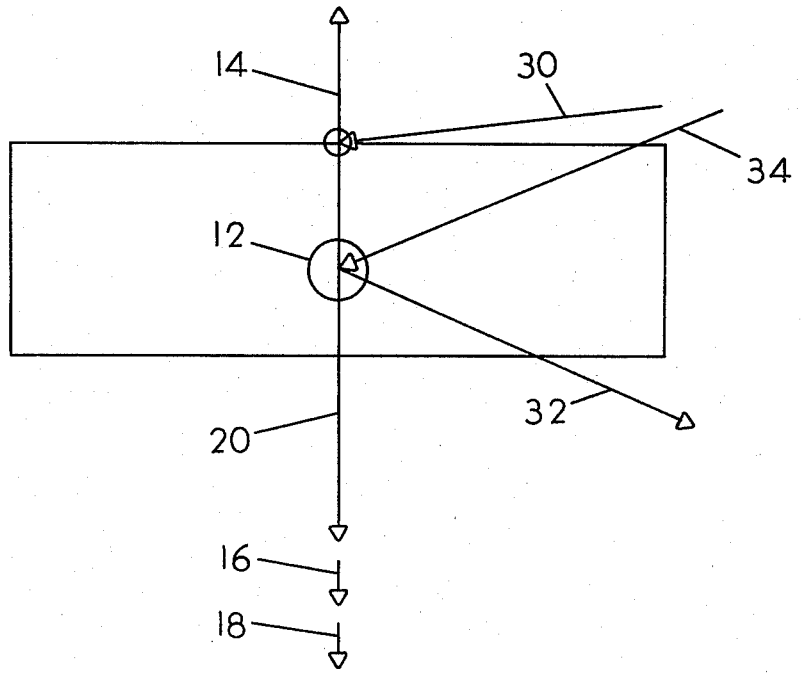

FIG. 2 represents the vector diagram produced when the forces applied to the buoy by the yoke are compression forces. Vectors 14, 16 and 18, which are respectively the buoy buoyancy, buoy weight and yoke weight supported by the buoy remain as before. The compression vector of the conventionally coupled yoke, 30, will apply force at the top of the buoy in a direction in tension. The buoy pitch axis remains the same. The chain vertical weight vector 20 remains the same. However, the chain resultant vector, 32, is in an opposite direction, to resist the yoke compression forces. It should be understood that there are chains all around the buoy anchoring it to the sea bottom.

From the foregoing it will be seen that there is still a tendency of the buoy to turn over, rotating about the pitch axis 12. However, if the yoke, in accordance with this invention, is connected to the buoy so that the compression forces are applied by it to the buoy at or substantially around the pitch axis, which is represented by the arrow 34, then the tendency for the buoy to be turned over is avoided.

Figure 3:
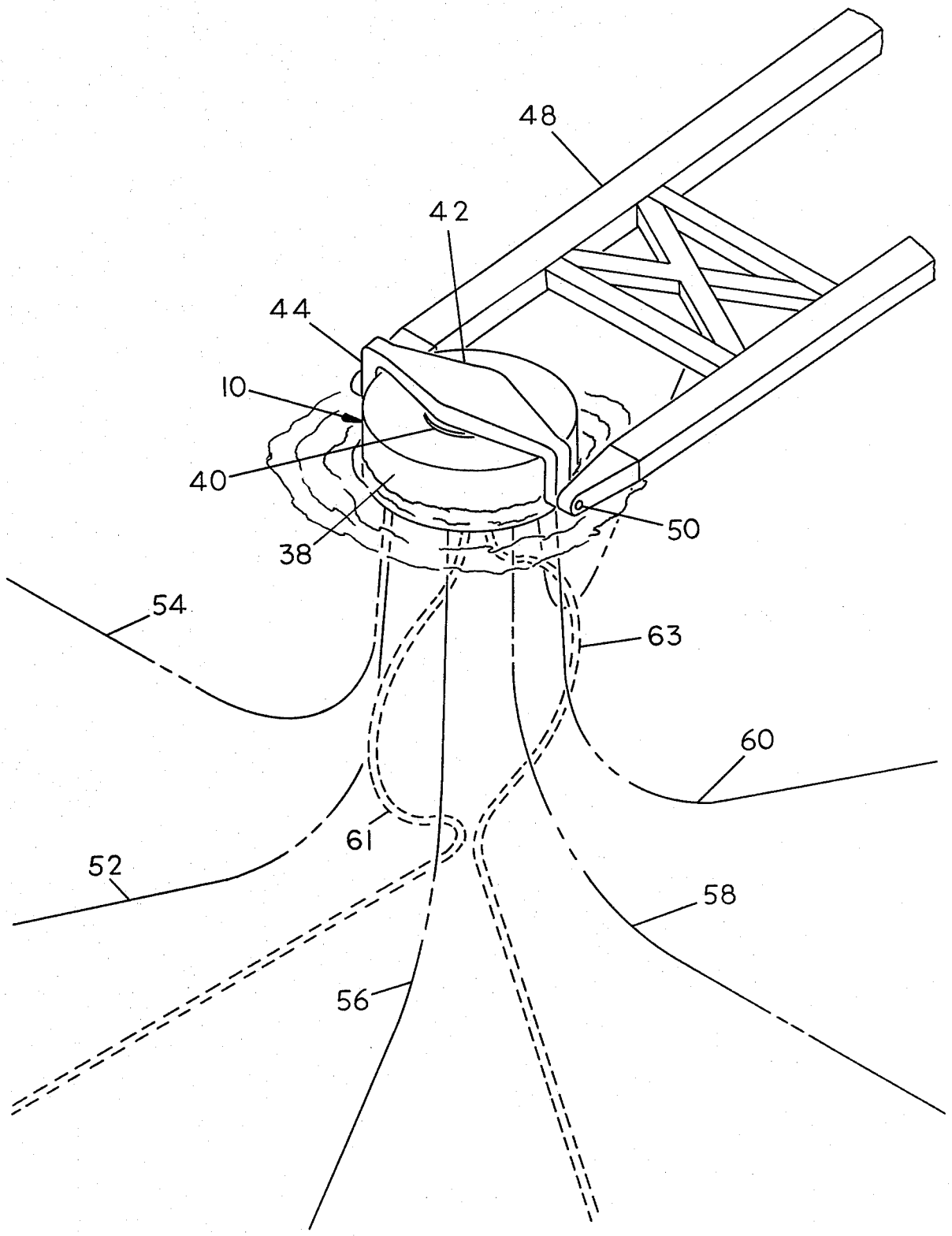
FIG. 3 is a perspective view of an embodiment of the invention.

Referring now to FIG. 3, there may be seen a perspective view of an embodiment of the invention. A buoy 10 including a large diameter buoyant member 38 which has a turntable 40 mounted on the top thereof to which there is attached a U-shaped member 42, to be rotatable therewith. This U-shaped member has its arms 44 extending downwardly below the top of the buoy and clear thereof, so that the mooring yoke 48, may be pivotably connected to the arms 44, by suitable pins 50. The arms 44, extend downwardly a sufficient amount, to enable the yoke to be pivotably connected thereto at the location of the pitch axis of the buoy. As the U-shaped member rotates, the axis to which the mooring yoke is connected describes a plane which contains the pitch axis. The other end of the mooring yoke may be coupled to a vessel in a known manner, to decouple the yoke from vessel pitch.

The buoy is anchored to the sea bottom as by suitable chains 52, 54, 56, 58, 60. The buoy may be of the type which in addition to serving for mooring a vessel, can have a fluid swivel to enable the supply of fluid products to the vessel. Suitable hoses respectively 61, 63 carry fluid product to and from the buoy and by suitable swivel means, not shown, but which are well known to those skilled in the art, can carry fluid product from the buoy to the ship. Such swivel means may be mounted on top of the U-shaped coupling member 42.

Figure 4:
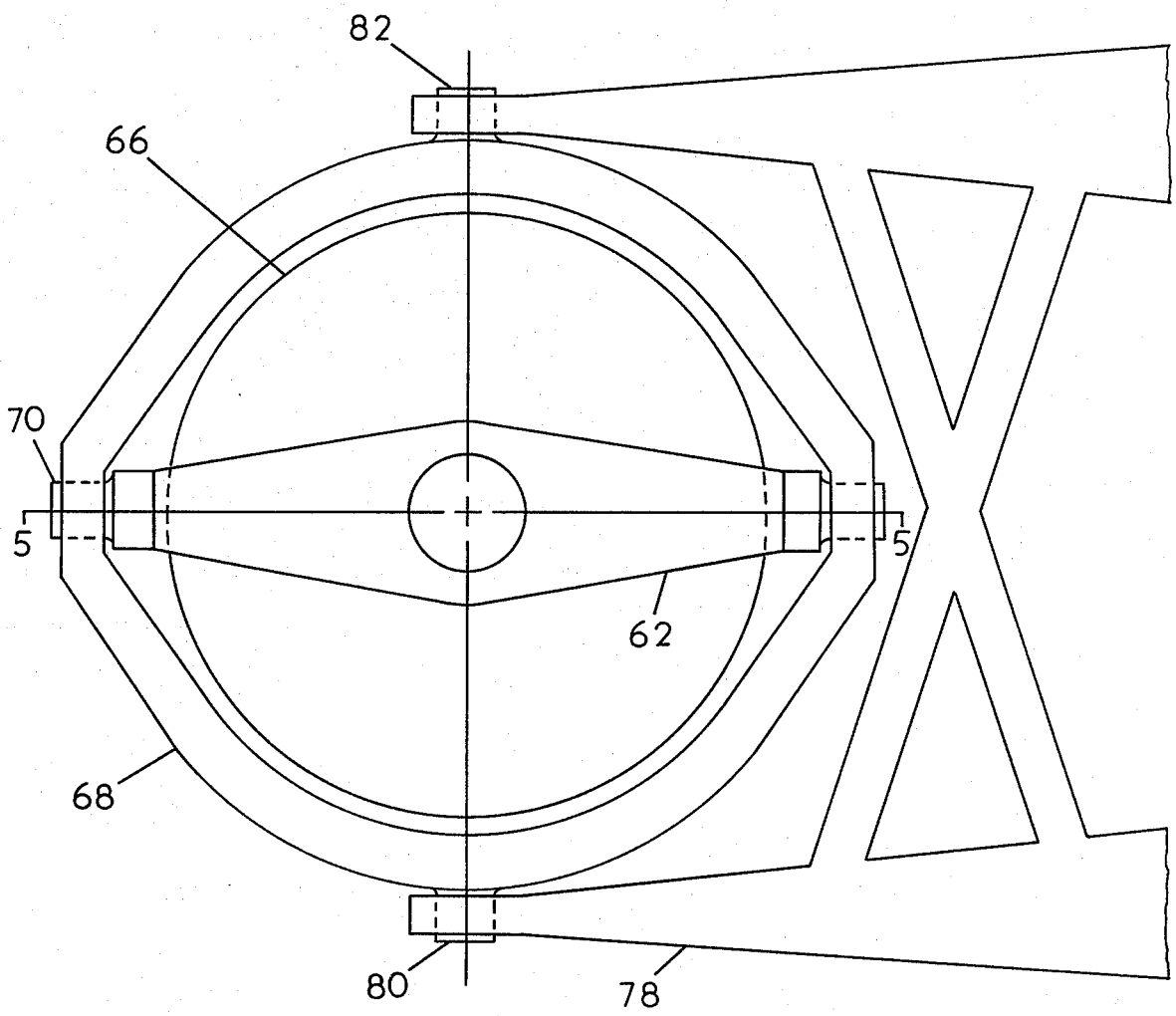
FIG. 4 is a view in elevation of another embodiment of the invention.
Figure 5:
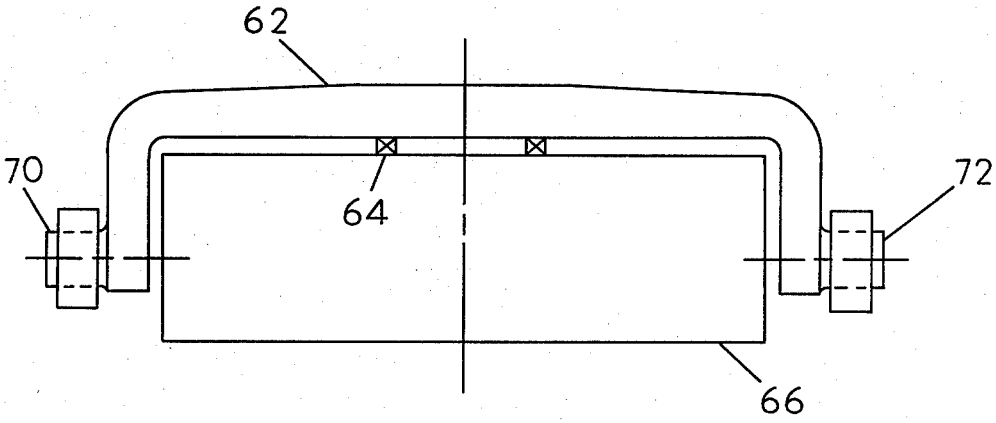
FIG. 5 is a cross-sectional view along the line 5—5 of FIG. 4.

FIG. 4 is a view in plan and FIG. 5 is a view in section along the lines 5—5 of another embodiment of the invention. Here, a U-shaped member 62, is mounted on bearings 64 which are on top of the buoy 66. The U-shaped member 62, which can be also called a clevis, has a ring 68 pivotably coupled thereto at locations 70, 72. These locations are at the level of the pitch axis and rotate to describe a plane which contains the pitch axis.

The yoke 78, which is coupled between the buoy and the ship, is pivotably connected to locations 80, 82, which are pins extending from the ring 68. Thus, these points are also within the plane including the pitch axis. The pivot points 80, 82 are on an axis which is substantially at right angles to the axis extending between the pivot points 70, 72.

The arrangement shown in FIG. 4 has the advantage over that shown in FIG. 3, of enabling independent roll motion of the ship without such motion being coupled to the buoy. The pitch motion of the ship is not coupled to the buoy either. The only forces applied to the buoy from the ship are therefore the forces in compression, in tension, and in yaw. Since these are applied to the pitch axis of the buoy, there is a minimal tendency for the buoy to pitch or roll.

Figure 6:
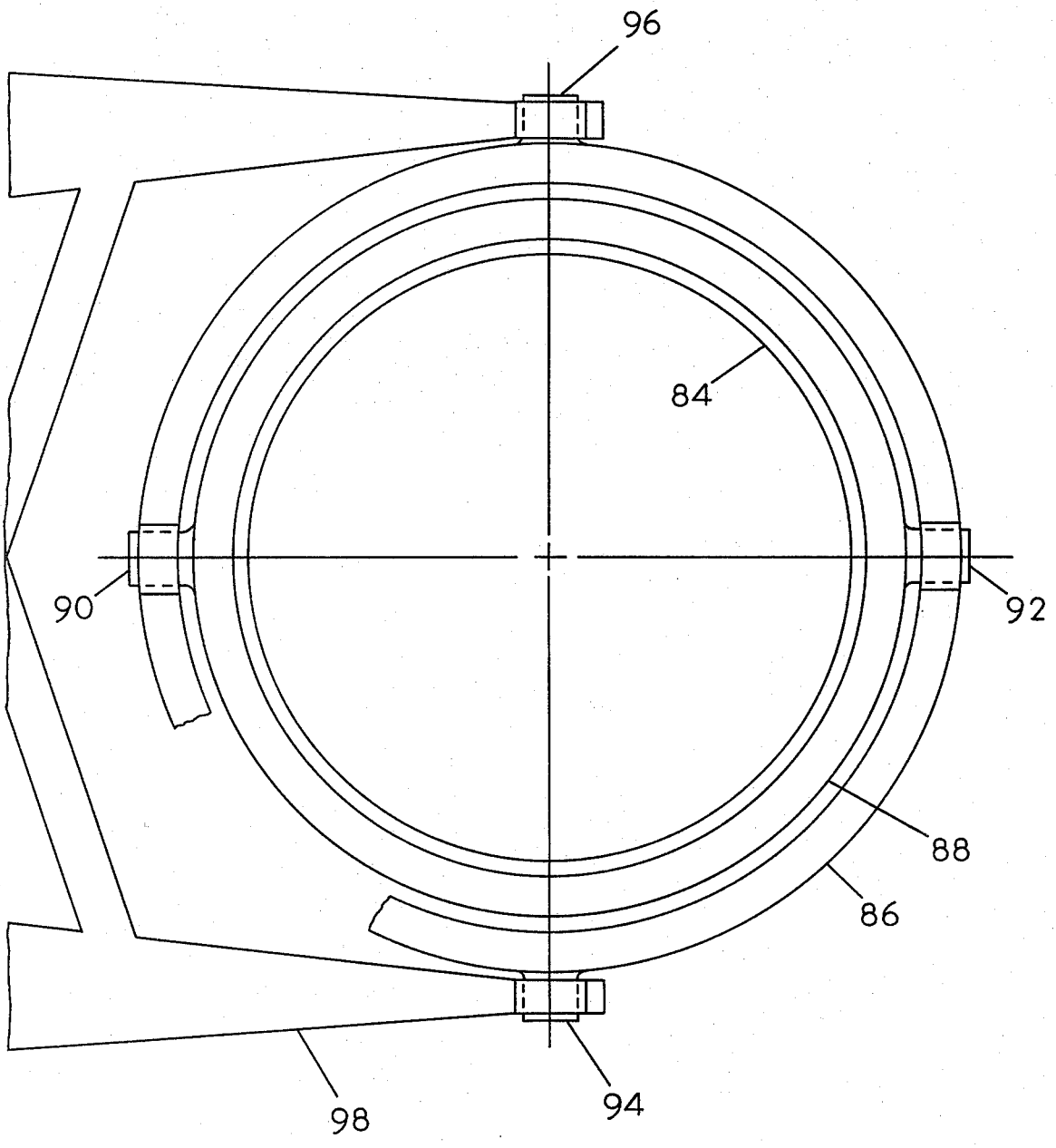
FIG. 6 is a view in elevation of still another embodiment of the invention.

FIG. 6 is a view in plan of another arrangement for decoupling the pitch and roll motion of the ship from the buoy, while still applying the tension and compression forces to the buoy from the ship, through the yoke at the pitch axis of the buoy. In this arrangement, the buoy 84, has an outer and inner gimbal ring, respectively 86, 88, positioned below the top of the buoy within the plane containing the pitch axis. The inner gimbal ring 88, is supported around the periphery of the buoy by bearings not shown. The pair of pins respectively 90, 92, extend outwardly from the inner gimbal ring and are located in the pitch axis plane and on an axis which intersects the center of the buoy. The outer gimbal ring 86 is pivotably supported on the pins 90, 92.

The outer gimbal ring also has a pair of outwardly extending pins 94, 96, which are on an axis which intersects the axis between the pins 90, 92 at substantially a 90° angle. The yoke 98 is pivotably mounted on the pins 94, 96.

Pitch motion of the yoke 98, is enabled by the pivotable coupling to the pins 94, 96, which may be said to be on the pitch axis. Roll motion of the ship, which is applied to the pins 94, 96, by the yoke 98, is decoupled from the buoy by the pivotable coupling to the pins 90, 92, which may be said to be on the roll axis. Accordingly, the ship is free to move in pitch and roll without affecting the buoy, which will accordingly receive only the yoke tension and yoke compression forces. These are ineffective to cause the buoy to turn over in view of the fact that they are applied to the pitch axis of the buoy. It will be understood that rotational motion in azimuth of the ship around the buoy is permitted by the bearing support of the inner gimbal ring 88.

As previously indicated while not shown, those skilled in the art will know how to couple hoses from shore along the sea bottom to the buoy and then through suitable fluid swivels from the buoy to the ship, so that the buoy can be used, not only for anchoring purposes, but also to either deliver product to or receive products from the ship.

Accordingly, there has been shown in the foregoing description, novel and useful arrangements for coupling a ship to a buoy through a yoke, in a manner so that the forces applied to the buoy by the ship, through the yoke, will not cause the buoy to be turned over.

I claim:

1. In a mooring system for a ship wherein a yoke is used to couple the ship to the buoy, the improvement comprising:

a U-shaped member;

means mounted on the top of said buoy, for supporting said U-shaped member for rotation about a vertical axis extending through the center of said buoy, and with the arms of said U-shaped member extending downwardly on either side of said buoy to be freely rotatable therearound;

said arms of said U-shaped member being sufficiently long to be intersected by a plane which is described by the pitch axis of said buoy when it is rotated through 360°; and means for pivotably coupling said yoke to the arms of said U substantially at the intersection of the plane of the buoy pitch axis with said arms, including a ring having a diameter larger than the diameter of said buoy about the vertical axis, means for pivotably coupling said ring to the ends of said U-shaped arms where they intersect at the pitch axis plane, and means for pivotably coupling said yoke to said ring along an axis which makes an angle of substantially 90° with an axis passing through the pivotable coupling means coupled to the arms of said U-shaped member.

2. In a mooring system for a ship wherein a yoke is used to couple the ship to a buoy of the mooring system, the improvement comprising:

a U-shaped member;

means mounted on the top of said buoy, for supporting said U-shaped member for rotation about a vertical axis extending through the center of said buoy, and with the arms of said U-shaped member extending downwardly on either side of said buoy to be freely rotatable therearound; and means for pivotably coupling said yoke to the arms of said U-shaped member.

3. In a system wherein a ship is anchored to a buoy which floats on the surface of a body of water and is held in place substantially only by a plurality of chains or the like that extends sidewardly and down to the seabed to limit drifting of the buoy from a predetermined position, but wherein the buoy is otherwise free to tilt, the improvement of means for coupling the ship to the buoy, comprising:

a substantially rigid yoke having a first end pivotally connected to the ship about substantially a first horizontal axis, and having a second end; and a U-shaped member with a middle portion rotatably mounted on the top of said buoy and arms extending downwardly on opposite sides of said buoy and pivotally coupled to said yoke about substantially a second horizontal axis that lies a distance below the top of the buoy, so that movement of the ship in a direction toward or away from the buoy results in substantially minimum tilting of the buoy.

* * * * *